United States Patent [19]

Duperow et al.

[11] 4,009,988

[45] Mar. 1, 1977

[54] GAS VALVE AND MIXING TUBE ASSEMBLY FOR GAS BURNER

[75] Inventors: Donald E. Duperow; Norbert Hughes, both of Detroit, Mich.

[73] Assignee: Lincoln Brass Works, Inc., Detroit, Mich.

[22] Filed: Dec. 29, 1975

[21] Appl. No.: 644,896

[52] U.S. Cl. ..... 431/114; 285/49; 285/174; 431/354

[51] Int. Cl.[2] ..... F23D 11/00

[58] Field of Search ..... 431/354, 355, 114; 285/49, 174

[56] References Cited

UNITED STATES PATENTS

| | | | |
|---|---|---|---|
| 3,348,862 | 10/1967 | Leopold et al. | 285/174 X |
| 3,501,098 | 3/1970 | Evans | 431/354 X |
| 3,791,680 | 2/1974 | Cleare | 285/174 |
| 3,807,776 | 4/1974 | Bingham | 285/174 |
| 3,823,965 | 7/1974 | Emberson | 285/174 |
| 3,905,756 | 9/1975 | Ferlih et al. | 431/354 |

*Primary Examiner*—Edward G. Favors
*Attorney, Agent, or Firm*—Barnes, Kisselle, Raisch & Choate

[57] ABSTRACT

A gas valve and mixing tube for a gas burner are held frictionally together by a plastic bushing which fits around the hood of the valve and within the upstream end of the mixing tube. The body of the bushing and a flange thereon maintain adjacent parts of the valve and tube out of metal-to-metal contact to eliminate rattling. The bushing is short enough not to interfere with the primary air inlet opening. Interior ribs in the bushing permit articulation of the valve and tube to facilitate installation in cramped quarters. The bushing and internal ribs are tapered to facilitate assembly of the three parts.

21 Claims, 5 Drawing Figures

GAS VALVE AND MIXING TUBE ASSEMBLY FOR GAS BURNER

This invention relates generally to an assembly of a gas valve and mixing tube for a gas burner of the type used in domestic ranges. More particularly, the invention relates to the joint between the valve and mixing tube.

Conventionally, the hood forming the outlet orifice of the valve is detachably secured within the upstream end of the mixing tube by a frictional metal-to-metal interengagement of the two parts. To effect such a connection, the upstream end of the tube is conventionally dimpled, slit and bent inwardly or otherwise deformed to provide a resilient frictional grip around the hood of the gas valve. Two disadvantages are inherent in this structure. First, the manufacturing step of deforming the tube end is relatively expensive. Second, the joint almost inevitably rattles when subjected to vibration, such as when the assembly forms part of a gas range in a motor home or other recreational vehicle.

It is very difficult to hold the manufacturing tolerances close enough to prevent such rattling even when the assembly is newly installed in a gas range. Even if a relatively tight grip is attained initially, it is almost always destroyed in the course of subsequent dismantling and reassembly for cleaning or maintenance purposes since the gripping deformities in the tube become spread, and sometimes the metal of the tube, typically steel, scores the softer metal of the valve hood, typically brass or aluminum, further loosening the joint. Additionally, where the mixing tube is relatively long, i.e., 12 to 18 inches, it is sometimes necessary to articulate the joint somewhat to install the assembly in a relatively confined space which loosens an initially tight grip. If the hood of the valve is aluminum, the latter procedure can break the hood off.

The object of the present invention is to provide a relatively simple joint structure between a gas valve and a mixing tube which is improved to reduce the cost of manufacture and to eliminate rattling both initially and subsequently during the course of use. One form of the invention is illustrated in the accompanying drawings in which.

Figure 1:
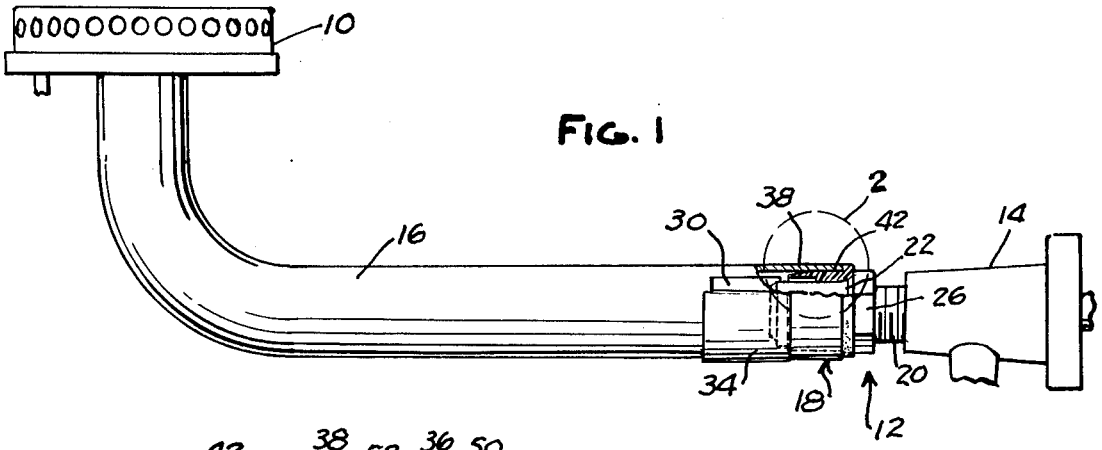
FIG. 1 is a side elevational view of an assembly according to the present invention with parts broken away and shown in section to illustrate structural details.
Figure 2:
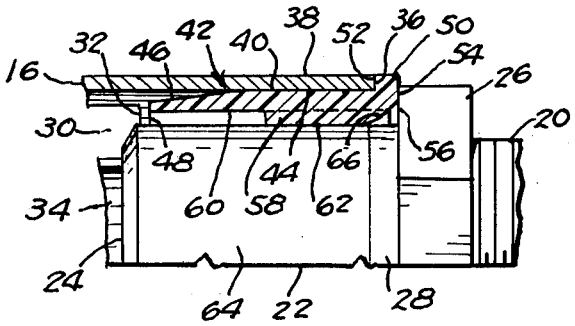
FIG. 2 is an enlarged scale fragmentary sectional view of the structure contained in circle 2 of FIG. 1.
Figure 3:
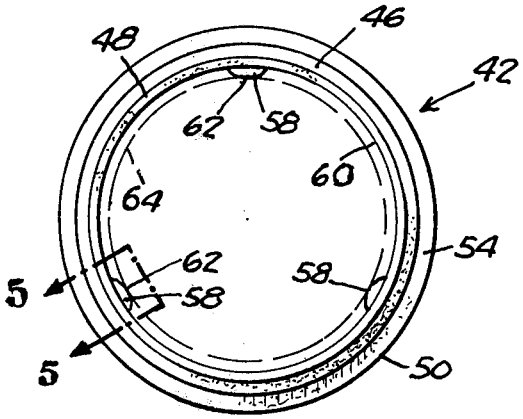
FIG. 3 is a front elevational view of a plastic bushing separate from the other parts.
Figure 4:
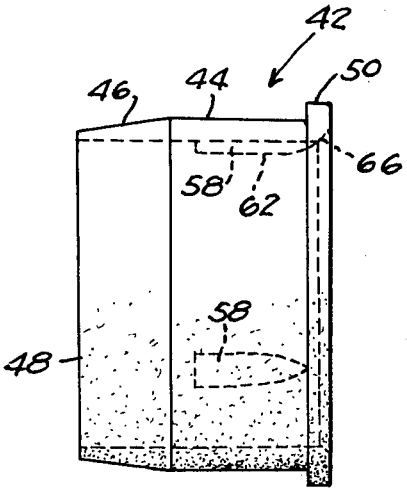
FIG. 4 is a side elevational view of the bushing shown in FIG. 3.
Figure 5:
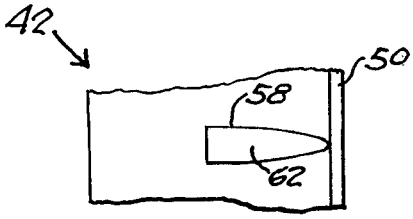
FIG. 5 is a fragmentary internal elevational view of the bushing looking in the direction of arrows 5—5 of FIG. 3.

Shown in the drawings is a gas burner 10 which is furnished with a fuel mixture by an assembly 12 of a gas valve 14 and a mixing tube 16 detachably interconnected by a joint 18 according to the present invention. Valve 14 is conventional in that it has an outlet nipple 20 onto which a hood 22 is threaded, the hood having a downstream end 24 which contains an outlet orifice (not shown) after injecting fuel gas into the interior of mixing tube 16. As is conventional, hood 22 is provided with a nut configuration 26 to facilitate threading it onto nipple 20 and a shallow circumferential groove 28 is rolled into the hood adjacent nut 26 to tighten the internal threading in the hood against the threading on nipple 20. Tube 16 is conventional in that it has one or more primary air inlet openings 30 whose upstream ends 32 are generally axially adjacent end 24 of the hood. The effective size of the primary air opening or openings may be adjusted by means of a shutter 34, as is conventional.

Tube 16 has an upstream end face 36. In accordance with the invention, a portion 38 of the tube between end face 36 and upstream end 32 of primary air opening 30 is provided with an internal cylindrical surface 40. A bushing 42 of plastic or other elastomeric material has a generally cylindrical exterior surface 44 which fits frictionally against surface 40. Adjoining surface 44 the bushing has a conical exterior surface 46 which extends to an end 48 of reduced diameter. At its other end the bushing has a radial flange 50, one surface 52 of which is engaged axially against end face 36 of tube 16, and the other surface 54 of which is engaged axially against a radial face 56 of nut 26 opposed to end face 36.

Bushing 42 has a series, preferably at least three, of ribs 58 projecting radially inwardly from its interior surface 60. Ribs 58 are axially elongate, and each has a radially inner surface portion 62 frictionally engaged against the cylindrical exterior surface 64 of hood 22. Each rib is tapered radially outwardly adjacent flange 50 as at 66. On the one hand, each rib has an axial length at least great enough to span groove 28, which typically is about one eighth inch wide, but on the other hand, each rib is shorter than the axial length of bushing 42 between end 48 and surface 52 of flange 50. A suitable material for bushing 42 is nylon such as that commercially available as Zytel 101.

The parts can be assembled manually or otherwise by inserting bushing 42 into tube portion 38 and inserting hood 22 into the bushing, the sequence being immaterial. Tapered end 46 of the bushing facilitates insertion into tube 16, and outwardly tapered ends 66 of ribs 58 facilitate insertion of hood 22 into the bushing. In assembled relation of the parts, ribs 58 are radially squeezed and deformed against hood surface 64, the reacting forces in the elastomeric material causing outer surface 44 of the bushing to engage snugly against inner surface portion 40 of the tube. Hood 22 is thus frictionally secured within bushing 42 and the bushing, in turn, is frictionally secured within tube 16. As a consequence, the tube and valve 14 are frictionally secured in assembled relation by the bushing.

In use, the bushing body prevents any metal-to-metal contact between hood 22 and wall portion 38 of tube 16, and flange 50 prevents any metal-to-metal contact between end face 36 of the tube and end face 56 of nut 26, thereby eliminating the possibility of any rattling contact between the valve and tube. The axial length of bushing 42 between flange surface 52 and end 48 is such that there is no substantial axial overlapping of the bushing with respect to primary air inlet 30 such as would interfere with the inspiration of primary air into tube 16. In the structure illustrated, end 48 of the bushing is located upstream of upstream end 32 of opening 30. Ribs 58 are axially short enough to facilitate articulation of joint 18 by swinging valve 14 or tube 16 sideways relative to the other as is sometimes necessary to install assembly 12 into a cramped space. The elastomeric properties of bushing 42 resiliently return the valve and tube to their proper alignment once the installation has been made. The valve and mixing tube can be quickly and easily manually disassembled and reassembled for cleaning and maintenance purposes without harming joint 18 in any way or reducing its effectiveness to prevent rattling.

The cost of a typical bushing 42 in production quantities is less than one cent each. Because of the particular production procedures used in making an assembly 12, no additional production cost is incurred by the use of bushings 42. By way of comparison, the cost of conventional methods of preparing a mixing tube for assembly with a valve, such as slitting, bending, deforming, etc. is typically in the range from about 2½ cents to about 6 cents per mixing tube.

We claim:

1. In an assembly of a valve and a mixing tube for a burner, the valve having a metal body which includes an outlet hood for fuel gas, the mixing tube being formed of metal and having an upstream end portion into which the hood is inserted, improved structure which comprises, plastic bushing means having an inner surface portion frictionally fitted against the exterior of said hood, said bushing means having an outer surface portion frictionally fitted against the interior of said upstream end portion of said mixing tube, said bushing means forming a retainer which frictionally retains said hood and tube in assembled relation and forming a spacer which maintains the adjacent metal surfaces of said hood and tube out of contact with each other.

2. The structure defined in claim 1 wherein said bushing means comprises a generally cylindrical bushing.

3. The structure defined in claim 2 wherein said outer surface portion adjoins another outer surface portion which tapers to a smaller diameter end to facilitate insertion of said bushing into said tube.

4. The structure defined in claim 3 wherein the first said outer surface portion is generally cylindrical and said other surface portion extends generally along a cone.

5. The structure defined in claim 2 wherein said bushing has a flange which extends radially outwardly of said outer surface portion into axial engagement against an end of said tube.

6. In an assembly of a valve and a mixing tube for a burner, improved structure which comprises plastic bushing means frictionally interfitted between, said valve and tube and maintaining the adjacent surfaces of said valve and tube out of contact with each other, said bushing means comprising a general cylindrical bushing which has outer and inner surface portions frictionally engaged respectively with interior and exterior surfaces of said tube and valve, said bushing having a flange which extends radially outwardly of said outer surface portion into axial engagement against an end of said tube, said tube having a primary air inlet opening spaced axially from said end, said bushing having an end within said tube spaced axially from said flange by a distance no greater than the axial dimension between said tube end and opening.

7. The structure defined in claim 6 wherein said distance is less than said dimension.

8. The structure defined in claim 5 wherein said hood has a radial projection which is axially opposed to said tube end, said flange forming a spacer which maintains said tube end and projection out of contact with each other.

9. The structure defined in claim 2 wherein said bushing has a plurality of circumferentially spaced radially inward projections on its interior whose inner faces form said inner surface portions.

10. The structure defined in claim 9 wherein there are at least three of said inward projections.

11. In an assembly of valve and a mixing tube for a burner, improved structure which comprises plastic bushing means frictionally interfitted between said valve and tube and maintaining the adjacent surfaces of said valve and tube out of contact with each other, said bushing means comprising a general cylindrical bushing which has outer and inner surface portions frictionally engaged respectively with interior and exterior surfaces of said tube and valve, said bushing having at least three circumferentially spaced radially inward projections on its interior whose inner faces form said inner surface portions, said projections having the form of axially elongate ribs.

12. The structure defined in claim 1 wherein said ribs have an axial extent less than that of said bushing.

13. The structure defined in claim 12 wherein said bushing has an end into which said valve is inserted, said ribs being tapered radially outwardly adjacent said end to facilitate insertion of said valve into said end.

14. The structure defined in claim 12 wherein said bushing has an end into which said valve is inserted, said ribs extending from said end axially through a distance greater than one eighth inch.

15. In an assembly of a valve and a mixing tube for a burner, improved structure which comprises plastic bushing means frictionally interfitted between said valve and tube and maintaining the adjacent surfaces of said valve and tube out of contact with each other, said bushing means comprising a general cylindrical bushing which has outer and inner surface portions frictionally engaged respectively with interior and exterior surfaces of said tube and valve, said outer surface portion adjoining another outer surface portion which tapers to a smaller diameter end to facilitate insertion of said bushing into said tube, said valve having a radial projection which is axially opposed to an end of said tube, said bushing having a flange which extends radially outwardly of said outer surface portion into axial engagement with said tube end and projection to form a spacer which maintains said tube end and projection out of contact with each other, said tube having a primary air inlet spaced axially from said tube end, said smaller diameter end of said bushing being spaced axially from said flange by a distance no greater than the axial dimension between said tube end and opening, said bushing having at least three radially inwardly projecting axially elongate ribs circumferentially spaced around its interior and whose inner faces form said inner surface portions, said bushing having an open end within said flange into which said valve is inserted, said ribs being tapered radially outwardly adjacent said open end to facilitate insertion of said valve into said open end, said ribs extending from said open end axially through a distance greater than one eighth inch but less than the axial extent of said bushing.

16. A plastic bushing having an inner surface and an outer surface, one of which is provided with at least three circumferentially distributed radial projections, said bushing being dimensioned to fit frictionally around the outlet hood of a gas valve and to fit frictionally within the inlet end of a mixing tube for a gas burner, with said projections engaged against one of said hood and tube, said bushing having a flange adjacent one end dimensioned to be fitted axially between the inlet end of the mixing tube and a nut on the hood, said bushing having an axial length between said flange and the opposite end of said bushing which is no greater than the axial distance between said inlet end and a primary air inlet opening in said tube.

17. The bushing defined in claim 16 wherein said projections are provided on said inner surface.

18. The bushing defined in claim 17 wherein said outer surface has a generally cylindrical portion diametered to fit frictionally within said inlet end and an adjoining generally conical portion which tapers to a smaller diameter at said opposite end.

19. The bushing defined in claim 18 wherein each of said projections has the form of an axially elongate rib.

20. The bushing defined in claim 19 wherein each rib extends axially from said one end of said bushing toward said opposite end thereof through more than one-eighth inch but through less than the axial extent of said bushing.

21. The bushing defined in claim 20 wherein each rib tapers radially outwardly adjacent said one end.

* * * * *